US008325456B2

(12) United States Patent
Takayanagi

(10) Patent No.: US 8,325,456 B2
(45) Date of Patent: Dec. 4, 2012

(54) OZONE-LESS STATIC ELIMINATOR

(75) Inventor: Makoto Takayanagi, Shizuoka (JP)

(73) Assignee: Trinc.Org, Shizuoka (JP)

( * ) Notice: Subject to any disclaimer, the term of this patent is extended or adjusted under 35 U.S.C. 154(b) by 315 days.

(21) Appl. No.: 12/623,629

(22) Filed: Nov. 23, 2009

(65) Prior Publication Data

US 2010/0128408 A1 May 27, 2010

(30) Foreign Application Priority Data

Nov. 27, 2008 (JP) ..... 2008-302325
Jan. 16, 2009 (JP) ..... 2009-007151

(51) Int. Cl.
*H01T 23/00* (2006.01)
*H05F 3/00* (2006.01)

(52) U.S. Cl. ..... 361/231; 361/213; 361/229

(58) Field of Classification Search ..... 361/212, 361/213, 230, 231, 225, 226, 229
See application file for complete search history.

(56) References Cited

U.S. PATENT DOCUMENTS

| | | | | |
|---|---|---|---|---|
| 5,055,963 | A * | 10/1991 | Partridge | 361/231 |
| 5,445,798 | A * | 8/1995 | Ikeda et al. | 422/121 |
| 6,103,190 | A * | 8/2000 | Tanimura et al. | 422/29 |
| 6,373,680 | B1 * | 4/2002 | Riskin | 361/231 |
| 6,785,114 | B2 * | 8/2004 | Gorczyca et al. | 361/231 |
| 7,054,130 | B2 * | 5/2006 | Gorczyca et al. | 361/231 |
| 7,126,807 | B2 * | 10/2006 | Mizuno et al. | 361/213 |
| 7,397,647 | B2 * | 7/2008 | Mizuno et al. | 361/213 |
| 8,059,383 | B2 * | 11/2011 | Post et al. | 361/230 |
| 2001/0023593 | A1 * | 9/2001 | Sato et al. | 62/176.1 |
| 2006/0187597 | A1 * | 8/2006 | Onezawa et al. | 361/56 |
| 2007/0263338 | A1 * | 11/2007 | Nakashima et al. | 361/220 |
| 2009/0116162 | A1 * | 5/2009 | Onezawa et al. | 361/213 |
| 2012/0162851 | A1 * | 6/2012 | Sato | 361/231 |

* cited by examiner

*Primary Examiner* — Rexford Barnie
*Assistant Examiner* — Christopher Clark
(74) *Attorney, Agent, or Firm* — Leighton K. Chong

(57) ABSTRACT

A static eliminator comprises an electric discharge portion, and a case in which the discharge portion for emitting ions in front thereof is disposed. The case includes an ion emitting opening and an ozone, etc suction opening. The ozone, etc generated in the discharge portion is sucked through the ozone, etc suction opening resulting in sucking air from the ion emitting opening in a direction opposite to that of ion emission through the ion emitting opening.

6 Claims, 5 Drawing Sheets

OZONE-LESS STATIC ELIMINATOR

TECHNICAL FIELD

This invention relates to an ozone-less or ozone-free static eliminator, more particularly a static eliminator or ionizer for removing generated ozone ($O_3$) and the other flotage in it.

BACKGROUND OF INVENTION

A conventional static eliminator or ionizer generates ions by ionizing air by electric discharge such as corona discharge, glow discharge or plasma discharge. At that time, since ozone is produced as by-product, ozone is emitted in addition to ions. Since the ozone is harmful to human body, the ozone causes materials such as rubber or the like to be hardened and deteriorated, or the ozone causes materials such as metals or the like to be oxidized and deteriorated, these become problems. Furthermore, environmental contamination due to the other flotage diverged or discharged from the case also become problems.

The present invention intends to solve problems in that the ozone is harmful to human body, the ozone causes materials such as rubber or the like to be hardened and deteriorated, or the ozone causes materials such as metals or the like to be oxidized and deteriorated. Furthermore, the present invention intends to prevent environmental contamination due to the other flotage diverged or discharged from the case.

Therefore, it is an object of the present invention to provide a static eliminator which can collect ozone or the other flotage, hereinafter referred to as ozone, etc generated by discharge of static eliminator.

It is the other object of the present invention to provide a static eliminator which can transfer the recovered ozone, etc containing gas to the area where the atmosphere is not seriously affected by ozone and then the ozone is naturalized.

It is another object of the present invention to provide a static eliminator which can detoxify the collected ozone by ozone processing device or filter and blow out or discharge the ozone into outside air.

SUMMARY OF INVENTION

To accomplish the objects, there is provided a static eliminator which comprises an electric discharge portion, and a case in which said discharge portion for emitting ions in front thereof is disposed, said case including an ion emitting opening and an ozone, etc suction opening, said ozone, etc generated in said discharge portion being sucked through said ozone, etc suction opening resulting in sucking air from said ion emitting opening in a direction opposite to that of ion emission through said ion emitting opening.

There is provided a static eliminator using wind to blow out generated ions which comprise an electric discharge portion, a first case which is provided with said discharge portion therein and has an ion emitting opening for emitting the ions in front of said discharge portion, and a second case disposed adjacent to said first case, said second case including air blower therein, said air blower blowing wind in a direction opposite to that of ion emission from said ion emitting opening of said first case to blow outside the ions through said ion emitting the opening of second case to recover it.

Other objects, features, and advantages of the present invention will be explained in the following detailed description of the invention having reference to the appended drawings:

DETAILED DESCRIPTION OF THE INVENTION

First Embodiment

Figure 1A:
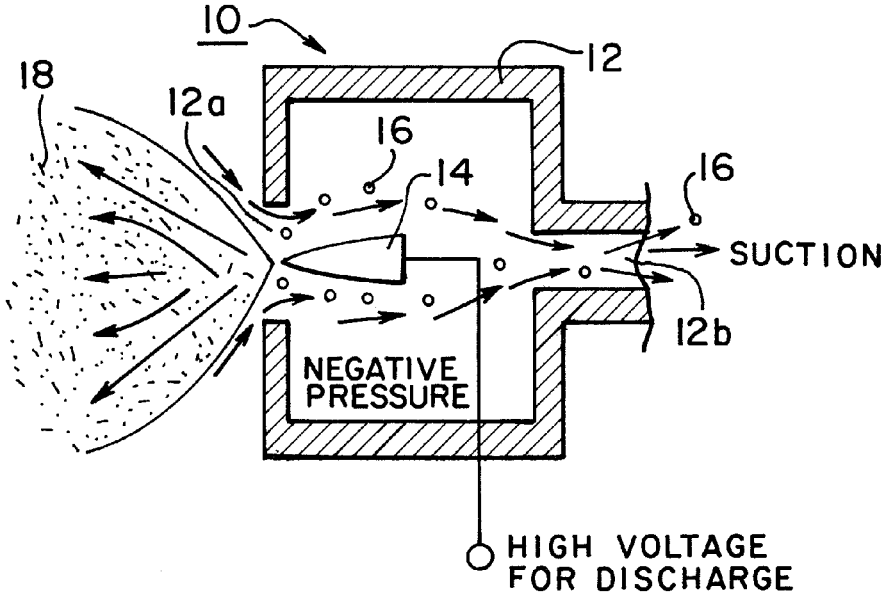
FIG. 1 is a cross-sectional view showing a first embodiment of static eliminator according to the present invention, FIG. 1A showing a corona discharge case, and FIG. 1B showing a plasma discharge case.
Figure 1B:
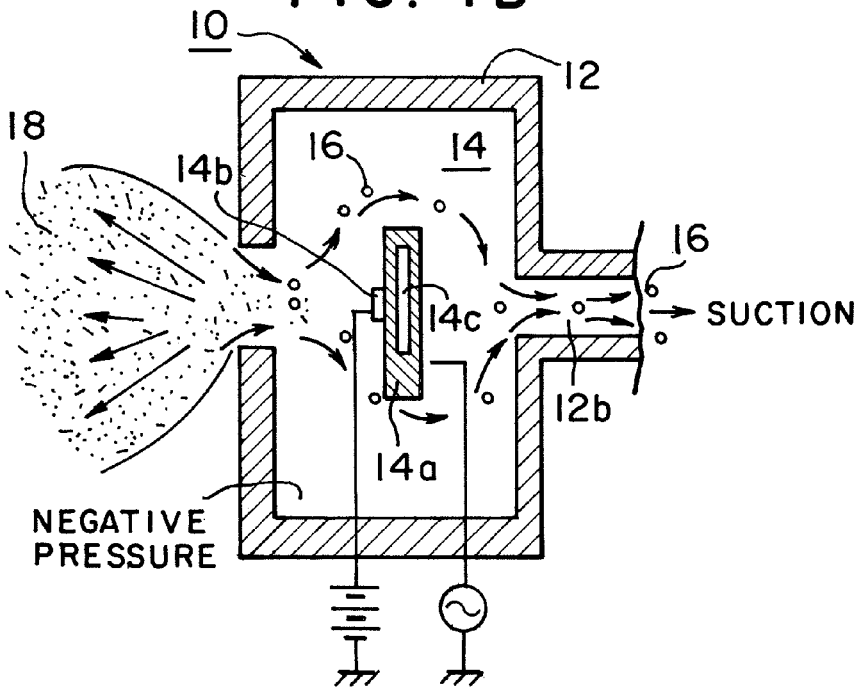

Now referring to FIG. 1, FIG. 1 is a cross-sectional view showing a first embodiment of static eliminator according to the present invention, FIG. 1A showing a corona discharge case, and FIG. 1B showing a plasma discharge case. In FIG. 1, there is shown an ion generating portion of no-wind type of static eliminator 10 in which ions 18 are flied away without a source of air sender or air blower. A discharge portion 14, discharge needle in the embodiment shown in FIG. 1A, is accommodated in a case 12 which has a ion emitting opening 12*a* in the front of the discharge portion 14. The ozone and the other flotage generated by electric discharge are collected by sucking air in a direction opposite to ion emitting direction through the ion emitting opening 12*a*.

The polarity of ions 18 generated by electric discharge corresponds to the polarity of discharge portion. For example, plus ions are generated from the plus discharge portion. On the other hand, minus ions are generated from the minus discharge portion. When the d.c. voltage is applied, the polarity is not changed. When a.c. voltage is applied, plus polarity and minus polarity are always conterchanged. Since the ions have same polarity as that of the discharge portion 14, ions 18 are flied away by coulomb repulsive force from the discharge portion 14.

In the meanwhile, since the ozone as by-product generated by electric discharge and the other flotage has non-polarity, attractive force or repulsive force is not acted between ozone or the flotage and the discharge portion. Therefore, the generated ozone or the flotage is on the float near the discharge portion. If there is an airflow, they ride an air flow and then move. When the negative pressure is generated in the case 12 for accommodating discharge portion 14 by suction from outside opposite to the ion emitting opening 12*a* from the outside, the floating ozone and the other flotage ride the airflow thus sucked and flow in an opposite direction to that of ions, and then are collected through ozone, etc suction opening 12*b*.

Although there is shown in FIG. 1A a discharge needle which generates ions by corona discharge, as shown in FIG. 1B the discharge portion 14 may be a plasma discharge type of discharge electrode, that is, a dielectric-barrier discharge type of discharge electrode in which an induction electrode 14*c* of electric conductor is disposed in an dielectric 14*a* and a discharge electrode 14*b* is provided on the surface of the dielectric 14*a*. In this case, high frequency voltage, for example, the voltage amplitude or P-P value of about 10 KV and the frequency of about 10 KHz is applied to the induction electrode 14*c*, and high voltage for bias of about 1 to 3 KV is applied to the discharge electrode 14*b* to maintain positive or negative polarity.

Such a plasma discharge electrode with positive or negative polarity can achieve the same effect as that of corona discharge needle with positive or negative polarity. Although examples using corona discharge needle are described in the following embodiments, the discharge portion may be a plasma discharge electrode as shown in FIG. 1B.

Second Embodiment

Figure 2A:
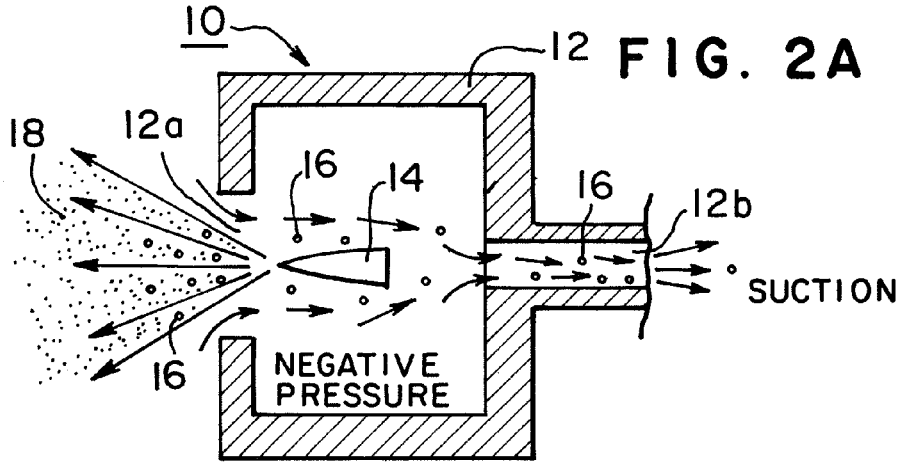
FIG. 2 is a cross-sectional view showing a second embodiment of static eliminator according to the present invention, FIG. 2A showing a case in that an ion emitting opening is big, and FIG. 2B showing a case in that an ion emitting opening is small.
Figure 2B:
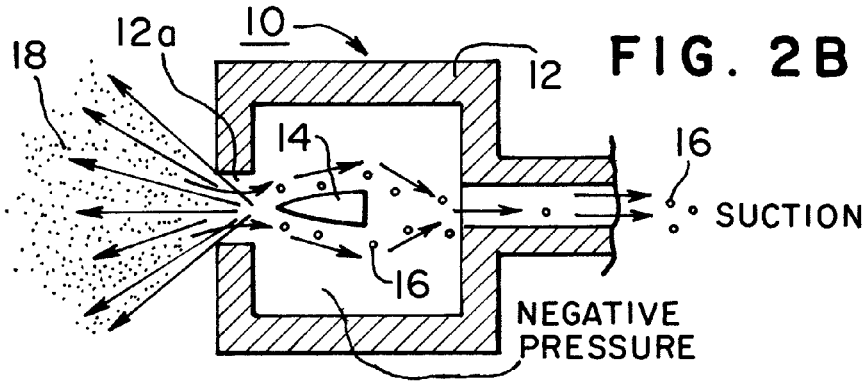

FIG. 2 is a cross-sectional view showing a second embodiment of static eliminator according to the present invention, FIG. 2A showing a case in that an ion emitting opening is big, and FIG. 2B showing a case in that an ion emitting opening is small. The airflow flowing inward through ion emitting opening 12*a* should be weak since strong airflow sucks ions and thus ions cannot be emitted through ion emitting opening 12*a*. Furthermore, it is preferable that the ion emitting opening 12*a* is as small as possible. In the case of bigger opening shown in FIG. 2*a*, ion wind blows outward at the center to emit ions 18, and at the same time suction wind blows inward around the center. That is, outward wind and inward wind are generated. The some of ozone and flotage rides the ion wind and goes out. The other of ozone and flotage is collected by the suction wind. As a result, rate of collection becomes worse.

In the meanwhile, in the case of smaller ion emitting opening shown in FIG. 2B, since the outward ion wind and inward suction wind are superimposed, ions 18 flows out by electrostatic repulsive force while the ozone and flotage which are not affected by electrostatic force rides an inward wind and flows inwardly. Therefore, rate of collection of ozone, etc are better. In order to generate inward weak airflow in a direction opposed to the ion emitting at the opening 12*a* by a little bit of negative pressure in the case 12, and collect the ozone, etc efficiently without disturbing ion emission, it is preferable that the area of the ion emitting opening 12*a* is approximately equal to the ion emitting area at the position of the ion emitting opening 12*a*.

Third Embodiment

Figure 3:
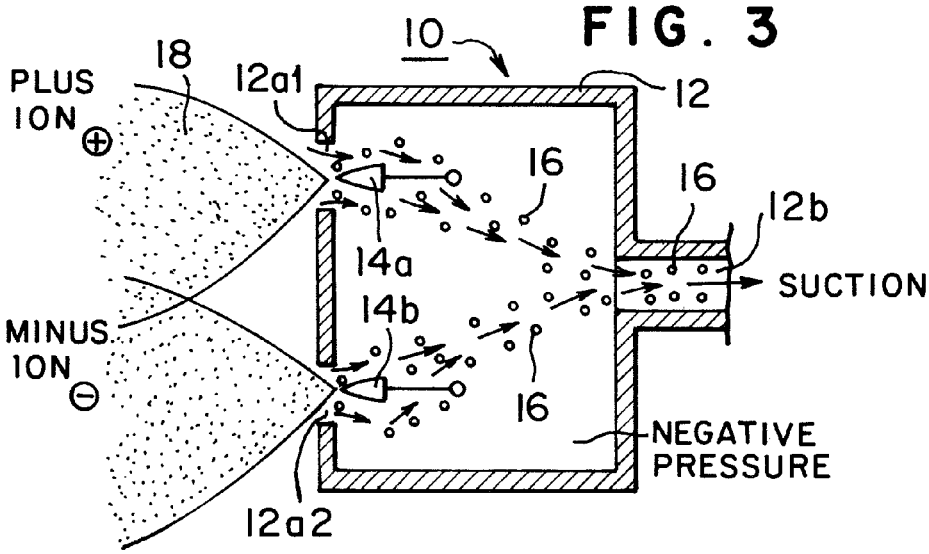
FIG. 3 is a cross-sectional view showing a third embodiment of static eliminator according to the present invention.

FIG. 3 is a cross-sectional view showing a third embodiment of static eliminator according to the present invention. In FIG. 3, the static eliminator is of d.c. static eliminator or ionizer type without air blow. The static eliminator has discharge portions 14*a* and 14*b* for emitting plus and minus ions. The case 12 is provided with suction portion having ozone, etc suction opening 12*b* to generate negative pressure in the case 12. Plus and minus ions 18 are emitted through ion emitting openings 12*a*1 and 12*a*2 while the ozone, etc produced at the discharge portions 14*a* and 14*b* rides an airflow which is sucked by the negative pressure and is directed inward from the ion emitting openings 12*a*1 and 12*a*2, and then the ozone, etc is collected. In order to collect the ozone, etc more efficiently it is preferable that the airflows which are sucked through the plus and minus ion emitting openings 12*a*1 and 12*a*2 are individually controlled.

Fourth Embodiment

Figure 4A:
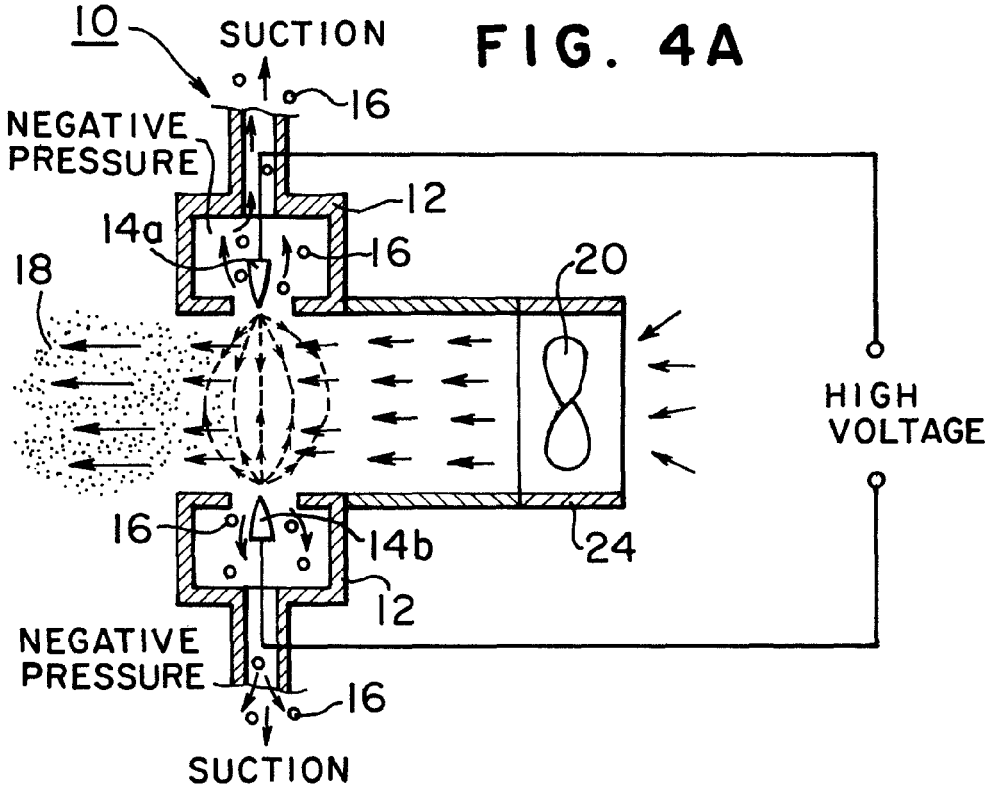
FIG. 4 is a cross-sectional view showing a fourth embodiment of static eliminator according to the present invention, FIG. 4A showing a case in that two discharging portions of different polarity are opposed to each other, and FIG. 4B showing a case in that one of opposed electrode is not a discharging electrode.
Figure 4B:
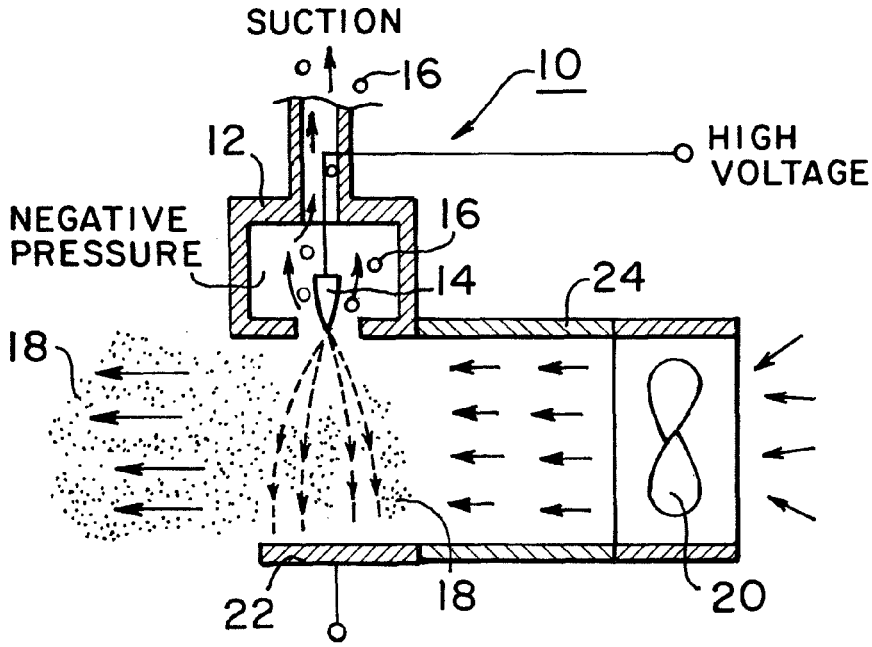

FIG. 4 is a cross-sectional view showing a fourth embodiment of static eliminator according to the present invention. The static eliminator is of a wind type in which external force such as air blower or air fan 20 is used to transfer ions 18 to the object to be discharged. The wind is generated, and ions 18 are caused to ride the wind. FIG. 4A shows a case in that two discharging portions of different polarity are opposed to each other, and FIG. 4B shows a case in that one of opposed electrode is not a discharging electrode.

In the front of one discharge portion, the other opposed discharge portion having a polarity opposite to that of the one discharge portion or an opposed electrode is disposed to enhance ion emitting or to enhance transfer of the emitted ions in a direction to the front of the one discharge portion.

In the static eliminator shown in FIG. 4A, two discharge portions 14*a* and 14*b* are disposed on the opposite sides of case 24 for defining airflow passage of air blower 20 to be opposed to each other. The polarities of their electrodes are opposite and the electrodes emit ions 18 of opposite polarities. Since the polarities of electrodes are opposite, ion emission is promoted and the ions thus emitted or generated are pulled out between the electrodes. The ions 18 flies out by repulsive force from discharge portions 14*a* and 14*b* while in the embodiment the ions are strongly pulled out by ion sucking force. That is, since ions receive push and pull effects and then flies out certainly, even if the ozone, etc 16 generated in the discharge portion are strongly sucked by negative pressure, the ions do not go back. That is, the collection of the ozone, etc can be carried out certainly. The ions 18 pulled out are transferred toward the object to be statically eliminated by the wind generated from air blower 20.

In the static eliminator shown in FIG. 4B, in place of two discharge portions one discharge portion 14 and an opposite electrode 22 opposed to the one discharge portion are provided. The opposite electrode 22 enhances the emission of the ions 18 from the discharge portion 14 and pulls the ions thus emitted or generated out from the discharge portion. The ions 18 flies out by repulsive force from discharge portion 14 while in the embodiment the ions are strongly pulled out by ion attracting force. That is, since ions receive push and pull effects and then flies out certainly, even if the ozone, etc generated in the discharge portion are strongly sucked by negative pressure, the ions do not go back. That is, the collection of the ozone, etc can be carried out certainly. The ions 18 pulled out are transferred toward the object to be statically eliminated by the wind generated from air blower 20.

Fifth Embodiment

Figure 5:
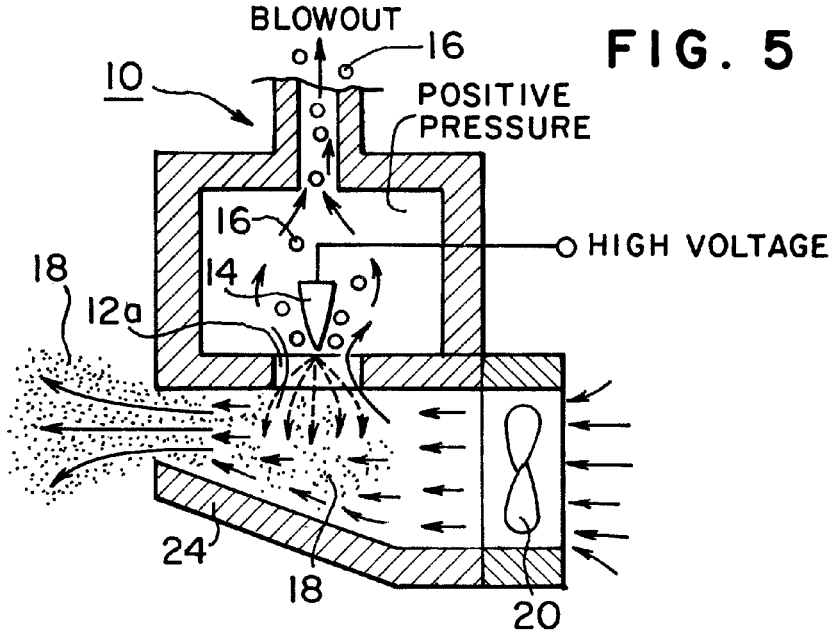
FIG. 5 is a cross-sectional view showing a fifth embodiment of static eliminator according to the present invention.

FIG. 5 is a cross-sectional view showing a fifth embodiment of static eliminator according to the present invention. Although in the aforementioned embodiments the ozone, etc are collected by suction due to negative pressure, in this embodiment the ozone, etc are collected by blowout due to positive pressure. The static eliminator is of a wind type in which the wind generated by an air blower 20 is used to blow the ions out. The ion emitting opening 12*a* is provided in front of the discharge portion. The ozone, etc generated by electric discharge are collected by blowing the wind in a direction opposite to that of ion emission from the ion emitting opening 12*a*.

Sixth Embodiment

Figure 6:
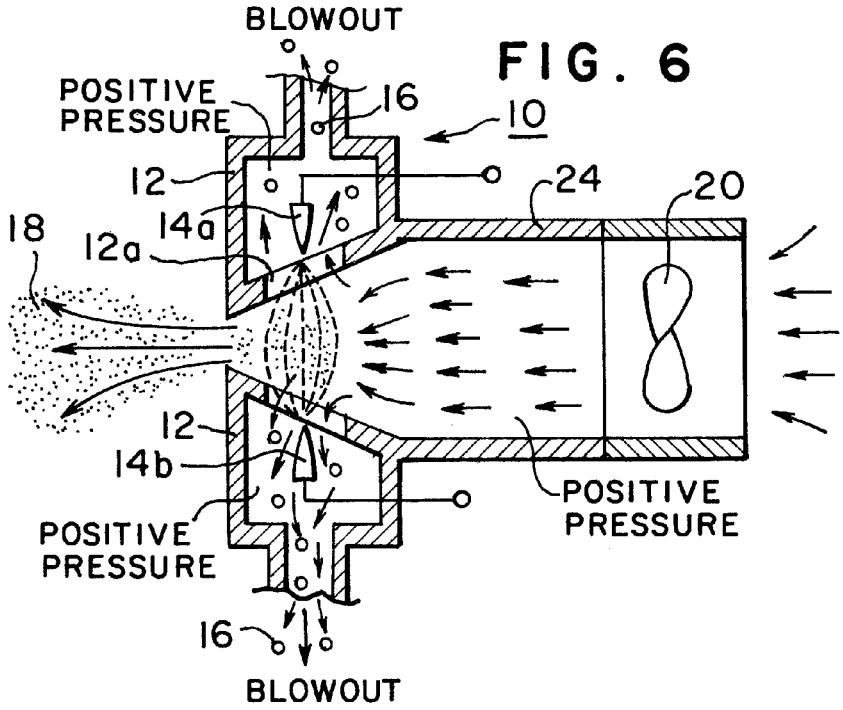
FIG. 6 is a cross-sectional view showing a sixth embodiment of static eliminator according to the present invention.

FIG. 6 is a cross-sectional view showing a sixth embodiment of static eliminator according to the present invention. In the embodiment the static eliminator is of a wind type in which the wind generated by an air blower 20 is used to blow the ions out. The ion emitting opening 12*a* is provided in front of one discharge portion having the discharge electrode 14*a*. The other emitting opening 12*a* is provided in front of the other discharge portion having the discharge electrode 14*b* or an opposite electrode, not shown. The discharge portions or ion emitting openings are provided on the opposite sides of the case 24 for defining airflow passage from the air blower 20. The ozone, etc generated by electric discharge are collected by blowing the wind in a direction opposite to that of ion emission from the ion emitting opening 12*a*.

Seventh Embodiment

Figure 7A:
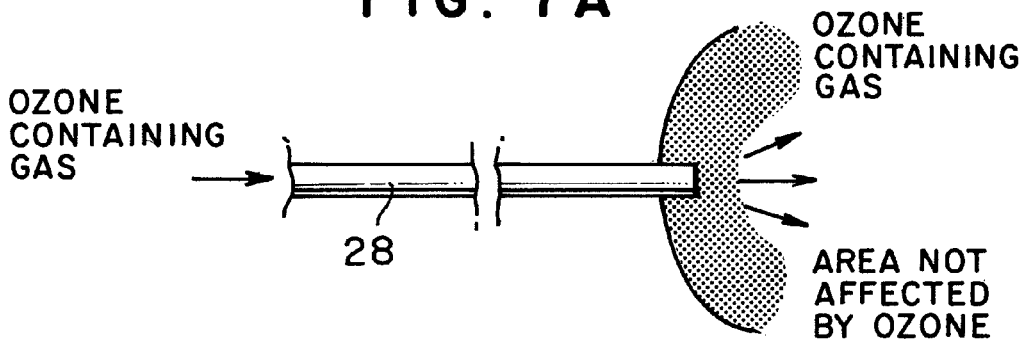
FIG. 7 is a view showing ozone recovering modes of seventh embodiment of static eliminator according to the present invention, FIG. 7A showing a system in which ozone is blown out in the atmosphere and then naturized, and FIG. 7B showing a system of resolving ozone through an ozone process and a filter process.

FIG. 7 is a view showing ozone naturalizing modes of seventh embodiment of static eliminator according to the present invention, FIG. 7A showing a system in which ozone is blown out in the atmosphere and then naturalized. The ozone containing gas is transferred to the area where the environment is not seriously affected by the ozone, etc and released in the environment.

Figure 7B:
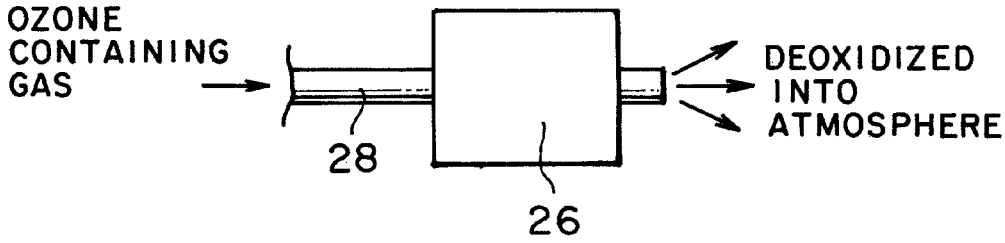

FIG. 7B showing a system of resolving ozone through an ozone process and a filter process. The collected ozone, etc containing gas is detoxificated by ozone processing device and filter 26 and then released in the environment. The ozone processing includes ozone decomposition, ozone absorption and the like.

It is understood that many modifications and variations may be devised given the above description of the principles of the invention. It is intended that all such modifications and variations be considered as within the spirit and scope of this invention, as it is defined in the following claims.

The invention claimed is:

1. A static eliminator which comprises a pair of ion emitting electrodes applied with opposite polarities of voltage and disposed to be opposite to each other, and a case having an air passage between said ion emitting electrodes, an ion emitting opening disposed at one side of the case through which ions are emitted outside, and an air blower disposed at an opposite side of the case for blowing a flow of air through said air passage toward said ion emitting opening, wherein ozone generated from ionized air by said ion emitting electrodes is sucked out or blown out in a direction perpendicular to the direction in which said flow of air streams from said air blower toward said ion emitting opening.

2. A static eliminator according to claim 1 in which said case is formed so that said air passage becomes narrower toward said ion emitting opening.

3. A static eliminator which comprises an ion emitting electrode for emitting ions, an ion non-emitting electrode disposed to be opposite to said ion emitting electrode, a case having an air passage between said ion emitting electrode and said ion non-emitting electrode, an ion emitting opening disposed at one side of the case through which ions are emitted outside, and an air blower disposed at an opposite side of the case for blowing a flow of air through said air passage toward said ion emitting opening, wherein ozone generated from ionized air by said ion emitting electrode is sucked out or blown out in a direction perpendicular to the direction in which said flow of air streams from said air blower toward said ion emitting opening.

4. A static eliminator according to claim 3 in which said case is formed so that said air passage becomes narrower toward said ion emitting opening.

5. A static eliminator which comprises an ion emitting electrode for emitting ions, a case having an air passage which ions emitted from said ion emitting electrode enter, an ion emitting opening disposed at one side of the case through which ions are emitted outside, and an air blower disposed at an opposite side of the case for blowing a flow of air through said air passage toward said ion emitting opening, wherein ozone generated from ionized air by said ion emitting electrode is blown out in a direction perpendicular to the direction in which said flow of air streams from said air blower toward said ion emitting opening.

6. A static eliminator according to claim 5 in which said case is formed so that said air passage becomes narrower toward said ion emitting opening.

* * * * *